US007976068B2

(12) United States Patent
Wicker et al.

(10) Patent No.: US 7,976,068 B2
(45) Date of Patent: Jul. 12, 2011

(54) DOUBLE-BLIND SECURITY FEATURES

(75) Inventors: Thomas M. Wicker, Hemlock, NY (US); David M. Wicker, Dansville, NY (US); Michael Scott Caton, Oakfield, NY (US)

(73) Assignee: Document Security Systems, Inc., Rochester, NY (US)

( * ) Notice: Subject to any disclaimer, the term of this patent is extended or adjusted under 35 U.S.C. 154(b) by 954 days.

(21) Appl. No.: 11/741,513

(22) Filed: Apr. 27, 2007

(65) Prior Publication Data

US 2007/0201116 A1 Aug. 30, 2007

(51) Int. Cl.
*B42D 15/00* (2006.01)
*B42D 15/10* (2006.01)

(52) U.S. Cl. ..... 283/72; 283/901; 283/902; 283/91; 235/491; 235/462.04; 358/3.28

(58) Field of Classification Search ..... 101/483, 101/485, 491; 235/491, 494, 462.04, 462.05, 235/468, 469; 283/72, 113, 117, 901, 902, 283/91, 92, 94, 86; 356/71; 358/3.28, 464; 359/567; 399/1, 366, 49, 72; 430/5; 428/29
See application file for complete search history.

(56) References Cited

U.S. PATENT DOCUMENTS

| | | | |
|---|---|---|---|
| 3,675,948 | A | 7/1972 | Wicker |
| 4,143,967 | A | 3/1979 | Wicker |
| 4,255,652 | A | 3/1981 | Weber |
| 4,313,087 | A | 1/1982 | D'Amato et al. |
| 4,591,189 | A | 5/1986 | Holmen et al. |
| 5,018,767 | A | 5/1991 | Wicker |
| 5,149,140 | A | 9/1992 | Mowry et al. |
| 5,171,040 | A | 12/1992 | Orndorff |
| 5,193,853 | A | 3/1993 | Wicker |
| 5,297,815 | A | 3/1994 | Anderson |
| 5,487,567 | A | 1/1996 | Volpe |
| 5,707,083 | A | 1/1998 | Wallace |
| 5,708,717 | A | 1/1998 | Alasia |
| 5,735,547 | A | 4/1998 | Morelle et al. |
| 5,788,285 | A | 8/1998 | Wicker |
| 6,000,728 | A | 12/1999 | Mowry |
| 6,104,812 | A | 8/2000 | Koltai et al. |

(Continued)

FOREIGN PATENT DOCUMENTS

| | | |
|---|---|---|
| CA | 2207127 | 12/1997 |

(Continued)

OTHER PUBLICATIONS

Wilson, Carla, " Plastic cash promotes Island projects," Times Colonist, Dec. 4, 2003.

(Continued)

*Primary Examiner* — Dana Ross
*Assistant Examiner* — Pradeep C Battula
(74) *Attorney, Agent, or Firm* — Stephen B. Salai, Esq.; Brian B. Shaw, Esq.; Harter Secrest & Emery LLP

(57) ABSTRACT

A compound security feature is formed by printing latent images together with visually integrated settings using an invisible ink. Even if illuminated by a wavelength capable of rendering the inks visible, the latent images remain visually indistinguishable from their visually integrated settings. However, the latent images and visually integrated settings differ in one or more less obvious ways so that the latent images can be distinguished by using a visual aid.

23 Claims, 2 Drawing Sheets

U.S. PATENT DOCUMENTS

| | | | | |
|---|---|---|---|---|
| 6,209,922 | B1 | 4/2001 | Klein | |
| 6,305,718 | B1 | 10/2001 | Kendrick | |
| 6,491,215 | B1 | 12/2002 | Bofill et al. | |
| 6,692,030 | B1 | 2/2004 | Phillips | |
| 6,714,748 | B1 | 3/2004 | Nakayasu | |
| 6,865,001 | B2 | 3/2005 | Long et al. | |
| 2002/0114931 | A1 | 8/2002 | Toivakka et al. | |
| 2003/0030271 | A1 | 2/2003 | Wicker | |
| 2005/0094811 | A1* | 5/2005 | Mentz | 380/201 |
| 2005/0219599 | A1 | 10/2005 | White et al. | |
| 2005/0225080 | A1* | 10/2005 | Wicker | 283/117 |
| 2007/0029394 | A1 | 2/2007 | Wicker | |

FOREIGN PATENT DOCUMENTS

| | | | |
|---|---|---|---|
| DE | 19518228 | A | 11/1996 |
| EP | 0256176 | | 2/1988 |
| GB | 1434907 | | 5/1976 |
| GB | 2217258 | | 10/1989 |
| GB | 1344866 | A | 1/2004 |
| WO | WO 90/08046 | | 7/1990 |
| WO | 9840223 | | 9/1998 |
| WO | WO 03/013870 | A3 | 2/2003 |
| WO | WO 93/22145 | | 11/2003 |
| WO | WO 2004/033229 | A2 | 4/2004 |
| WO | WO 2004/068421 | A2 | 8/2004 |
| WO | WO 2004/110773 | A1 | 12/2004 |
| WO | WO 2006/001793 | A1 | 1/2006 |
| WO | 2006029033 | | 3/2006 |
| WO | WO 2006/029033 | A2 | 3/2006 |
| WO | WO 2007/016536 | A2 | 8/2006 |

OTHER PUBLICATIONS

Adler Tech International, Power Point slide presentation, "2002 Demo", alleged to have bee shown to numerous parties from Apr. 2003 to Aug. 2003.

2002 Check Scan/Verification Demo.

Adler Tech International, Inc., "The World of Private Currency, HALO Covert Features," at www.adlertech.com. 2006.

Adler Tech International, Inc., "When Failure is Not an Option, Guardian Angel," at www.adlertech.com. 2006.

Adler Tech International, Inc., "When Failure is Not an Option, College of Physicians & Surgeons," at www.adlertech.com. 2006.

International Search Report, PCT/US2004/001360, mailed Nov. 23, 2004.

International Search Report, PCT/US2005/031440, mailed Apr. 27, 2006.

Central European Bank: "50 euro note" Data European Community, XX, XX, No. v1457742291, Jan. 1, 2002.

* cited by examiner

DOUBLE-BLIND SECURITY FEATURES

CROSS-REFERENCE TO RELATED APPLCIATIONS

None.

TECHNICAL FIELD

This invention relates generally to protected documents, document protection methods, and verification and authentication systems. In addition, the invention deals with invisible security features separately or in combination with visible security features and readers for detecting both types of features.

BACKGROUND OF THE INVENTION

Document embedded security features deter counterfeiting of valuable papers, important records, or financial instruments such as checks, currency, so that unauthorized copies of these documents can be readily distinguished from the originals. The printing of such original documents can be done either in black-and-white (B&W) or in color, and if in color, either in spot color, colored backgrounds and/or multicolor printing. Multiple colors are often preferred for original documents for aesthetic value and ease of recognition, as well as protection from copying by conventional means. The common printing processes of valuable originals, whether in B&W or in color, are intaglio (e.g., gravure), offset printing, among others. These and the other processes mentioned in this application are very well known in the art and will not be discussed in great detail.

One approach to deterring counterfeiting or other unauthorized reproduction of originals includes embedding of "latent images" often containing covert information or other indicia within the original documents. The latent images are intended to be practically invisible to the naked eye under normal viewing conditions, particularly as being indistinguishable from a visually integrated setting in which they are embedded. However, the latent images are otherwise distinguishable through the use of a visual aid, such as a magnifier. The latent images can be arranged to disappear from copies or to become more pronounced. That is, either the absence of the latent image or the visible presence of the latent image can be construed as an indication of a non-original document.

Another approach to deterring counterfeiting includes the use of UV and IR inks to create images that only appear when illuminated by UV or IR light. UV inks have been used on documents, such as banknotes, to provide an additional indication of authenticity when illuminated by UV light.

Other developments for purposes of providing document protection are disclosed in the patent literature, as for example, in U.S. Pat. No. 5,018,767 issued May 28, 1991; U.S. Pat. No. 5,193,853 issued Mar. 16, 1993; and U.S. Pat. No. 3,675,948 issued Jul. 11, 1972; and U.S. Pat. No. 4,143,967 issued Mar. 13, 1979, all to Ralph C. Wicker. All of these patents disclose various means for providing methods and products to enable copies of documents to be distinguished from the originals, as for example, by a "large dot-small dot pattern", a "close line-spaced pattern", and images or indicia which are screen printed at minutely varied spaces and/or angles on the originals and are intended to produce a highly visible moiré pattern effect on the unauthorized copies. In this specification, the words "print", "printed" and "printing" are used to refer to the making of an original document by any of a number of known printing means, including transferring images from one source to another, typically a paper medium, using a transfer agent such as ink or toner. The words "copy" and "copying" are used to refer to making copies from an original printed document.

Efforts to thwart anti-counterfeiting measures also continue to advance. The invention among its objectives is directed to providing compound document security features including one or more additional layers of protection. A need also exists to provide fast and accurate authentication of such documents.

SUMMARY OF THE INVENTION

The invention provides enhanced security for documents, including various forms of print media for commercial, personal, or official use. According to one aspect of the invention, a document is printed with a security image that is not visible under ordinary light. For example, the security image can be printed with an invisible ink that is rendered visible by photoluminescence under an appropriate wavelength of light. However, the invention also provides for hiding the security image even when illuminated by the appropriate wavelength of light. That is, both the security image and a visually integrated setting can be printed with the invisible ink, so that when illuminated by the appropriate wavelength of light, the security image remains practically visually indistinguishable from its visually integrated setting. A visual aid, such as a matching viewing device, is needed in addition to the special illumination to render the security image distinguishable from its surroundings.

One version of the invention as a document containing an invisible latent security image includes a printed substrate, which can take a variety of forms as paper, plastic, foil, film, or lamination. A first pattern of line elements forming a latent image is printed on the substrate in an invisible ink that is rendered visible by when illuminated by light containing a non-visible wavelength. A second pattern of line elements forming a visually integrated setting is also printed on the substrate in an invisible ink that is rendered visible when illuminated by the light containing the non-visible wavelength. The first and second patterns differ from each other but are not readily distinguishable to the unaided eye when illuminated by the light containing the non-visible wavelength.

Preferably, the first and second patterns appear as substantially the same color when illuminated by the light containing the non-visible wavelength. In addition, the first and second patterns are preferably printed with corresponding print densities. However, the line elements of the first and second patterns are preferably arranged in lines that are oriented at different angles separated by at least five degrees.

A third pattern of line elements can be printed on the substrate in a visible ink. At least one of the first and second patterns of line elements is preferably positioned to overlap the third pattern of line elements. The overlapping patterns can be arranged such that that any interference effects are substantially indistinguishable between the latent image formed by the first pattern and its visually integrated setting formed by the second pattern.

The light for illuminating the document can contain, in addition to the non-visible wavelength, a visible wavelength for illuminating the visible ink. A fourth pattern of line elements can be printed on the substrate in a visible ink. The third pattern can form a latent image, the fourth pattern can form a visually integrated setting, and the third and fourth patterns can be not readily distinguishable when illuminated by the light containing both invisible and visible wavelengths. One or both the first and second patterns of line elements can overlap the third and fourth patterns of line elements. The overlapping patterns of line elements in visible and non-visible ink are preferably printed in patterns such that any interference effects are substantially indistinguishable between the latent images formed by the first and third patterns and their visually integrated settings formed by the second and fourth patterns. That is, any interference between any of the overlapping patterns occurs at moiré frequencies that are not readily discernible. However, the latent image formed by the first pattern is distinguishable from its visually integrated setting formed by the second pattern when both (a) illuminated by the light containing the non-visible wavelength and (b) viewed through a reader containing a pattern matching one of the first and second patterns of line elements.

Another version of the invention as a document verification system includes a document printed with both visible and invisible ink. The invisible ink is rendered visible when illuminated by actinic radiation containing one or more invisible wavelengths. First and second patterns of line elements are printed with the invisible ink. The first pattern is formed as a latent image that is embedded within a visually integrated setting formed by the second pattern such that the latent image is substantially indistinguishable from its visually integrated setting when illuminated by the actinic radiation. A reader has a pattern of line elements corresponding to one of the first and second patterns so that in combination with the illumination by the actinic radiation, the latent image is distinguishable from its visually integrated setting.

Preferably, the reader includes a viewing device through which the document can be viewed for distinguishing the latent image from its visually integrated setting. The reader pattern can be printed on or otherwise formed in the viewing device. More than one reader pattern can be formed on the viewing device for separating other latent images from their visually integrated settings.

Another version of the invention involves a method of making a document with an embedded invisible security feature. A first pattern of line elements is printed on a document substrate as a latent image in an invisible ink that is rendered visible by when illuminated by light containing a non-visible wavelength. A second pattern of line elements is also printed on the document substrate as a visually integrated setting for the latent image in an invisible ink that is rendered visible when illuminated by the light containing the non-visible wavelength. Print densities of the first and second patterns are matched so that the first and second patterns remain substantially indistinguishable to the unaided eye when illuminated by the light containing the non-visible wavelength. However, the first and second patterns are otherwise differentiated so that the illuminated latent image of the first pattern is distinguishable from the illuminated visually integrated setting of the second pattern with a visual aid.

The first and second patterns preferably appear as substantially the same color when illuminated by the light containing the non-visible wavelength. However, the line elements of the first and second patterns are preferably printed in lines oriented at different angles separated by at least five degrees.

BRIEF DESCRIPTION OF THE DRAWING FIGURES

DETAILED DESCRIPTION OF THE INVENTION

Figure 1:
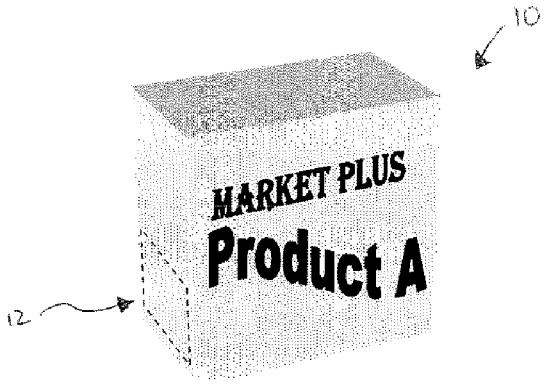
FIG. 1 is a perspective view of a product package containing an invisible security image according to an embodiment of the present invention.
Figure 2:
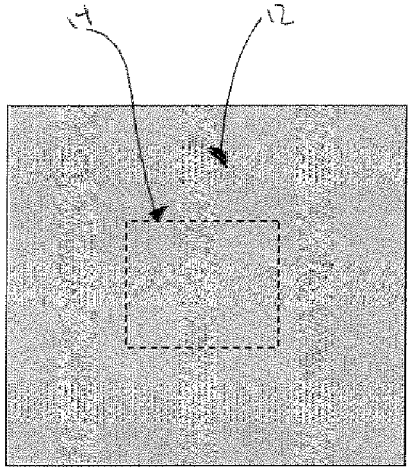
FIG. 2 is a view of an area of the product package from FIG. 1 showing an invisible ink region containing first and second patterns of line elements.

Referring now to the figures, FIGS. 1 and 2 are views of a verification system for a printing substrate 10, such as a product package, having an area 12 with an invisible ink region 14 printed thereon. The invisible ink area may be rendered visible by photoluminescence under an appropriate wavelength of light. For example, actinic radiation containing one or more invisible wavelengths can be used to illuminate the invisible ink. The printing substrate 10 is a print medium that can be any type of document, including but not limited to product packages, passports, legal documents, checks, identification cards, drivers licenses, currency, and laminate films. Further, any type of appropriate printing substrate material can be used, including but not limited to paper, vellum, paperboard, cardboard, parchment, foil, film, plastic, or lamination. The printing substrate 10 can also include visible ink within area 12, as discussed in more detail infra.

Figure 3:
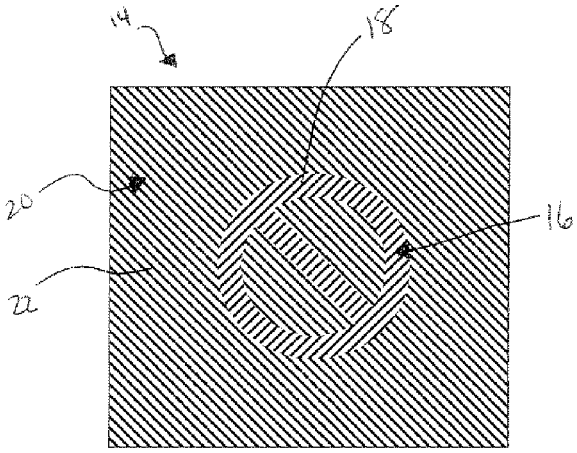
FIG. 3 is a view of the invisible ink region having a greatly reduced line frequency to illustrate the first and second patterns of line elements.

FIG. 3, having a line frequency that is greatly reduced to reveal first and second patterns for purposes of illustration, shows a first pattern of line elements 16 forming a latent image 18 printed on the substrate 10 in an invisible ink that is rendered visible when illuminated by light containing a predetermined non-visible wavelength. A second pattern of line elements 20 forms a visually integrated setting 22 for the latent image 18 printed on the substrate 10. When a light containing the non-visible wavelength illuminates the first and second patterns 16, 20, the patterns 16, 20 appear as the invisible ink region 14 having substantially the same color. That is, when illuminated by actinic radiation containing one or more invisible wavelengths, the invisible ink region 14, incorporating the latent image 18 and the visually integrated setting 22, is reveal as a glowing area. Although the first and second patterns 16, 20 differ from each other, the patterns 16, 20 are not readily distinguishable to the unaided eye. To view the latent image 18 in the invisible ink area 14, a visual aid, such as a reader device 24, is required.

The first and second patterns 16, 20 are printed with corresponding print densities. The print density of each pattern 16, 20 is ratio of the area occupied by the line elements compared to the overall area encompassed by the line elements, which includes the spaces between the line elements. The first and second patterns 16, 20 can have different numbers of lines per inch, also referred to herein as line frequency, and different line element widths, while still exhibiting corresponding print densities. Of course, equal line frequencies together with equal line element widths also produces corresponding print densities between the first and second patterns 16, 20. In a preferred embodiment, the first pattern 16 has a line frequency in the range of 160 to 200 lines per inch. In a more preferred embodiment, the first pattern 16 has a line frequency in the range of 175 to 185 lines per inch and even more preferably, 180 lines per inch. While the figures illustrate line patterns with the line elements themselves as line segments, it should be appreciated that the line elements of the latent image 18 and the visually integrated setting 22 can comprise lines, dots and/or spots printed with ultraviolet (UV), infrared, or any other ink invisible to the naked eye. The first and second patterns of line elements 16, 20 are arranged in lines oriented at different angles, separated by at least five degrees.

Figure 4:
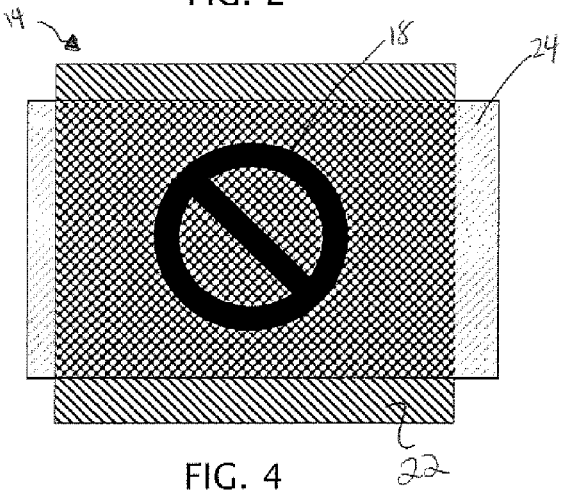
FIG. 4 is a view of a reader placed over the invisible ink region to reveal a latent image formed by the first pattern of line elements.

As shown in FIG. 4, the lines of the latent image 18 have a pattern such that, to view the latent image 18 in the invisible ink region 14, a reader device 24 is required, such as a flat transparent sheet or plate having a line frequency matching the line frequency of the latent image 18 or its visually integrated setting 22. Alternatively, the reader device 24 can have a line frequency that is related to the line frequency of the latent image 18 or its visually integrated setting 22 as an integer multiple. Placing the reader device 24 over the area 12 while viewing it under the predetermined type of light will cause the latent image 18 to appear. The pattern in the transparent reader device 24 can be translucent, whereby the pattern diffuses the light so that the latent image 18 appears as a solid image rather than a patterned image. Alternatively, the pattern in the transparent reader device 24 can have opaque lines, so that the latent image 18 appears as a patterned image when viewed by the reader device 24. Either way, the reader changes the contrast between the latent image 18 and its visually integrated setting 22.

The latent image 18 may also be seen by using an embossment or de-embossment, or by printing a visible or invisible line, dot, spot, indicia, or artwork image over the latent image 18 in visible or invisible inks, dies or pigments. Thus, this embodiment of the present invention raises the security of the document by making counterfeiting more difficult.

The image 18, such as the universal "no" sign, can be printed in UV ink having a line frequency of 180 lines per inch at a first angle. The visually integrated setting 22 can be printed in UV ink at the same line frequency but at a second angle different from the first angle. Again, it should be appreciated that the line patterns can be formed by line elements including dots, dashes, spots, line segments, swirls, or other shapes using conventional techniques, such that the latent image 18 cannot be distinguished from its visually integrated setting 22 even under UV light unless the reader device 24 is placed on top of the universal "no" sign while viewing it under UV light.

The reader 24 can be a film or plastic lens with substantially the same line pattern as the latent image 18 in shape, angle, or line frequency. The line pattern can be printed, embossed, debossed, or otherwise formed in the reader body. The reader 24 can be placed over the top of, or shined onto, the invisible ink region 14 to reveal the hidden image, portrait, barcode, indicia, picture, or other information contained in the latent image 18.

Figure 5:
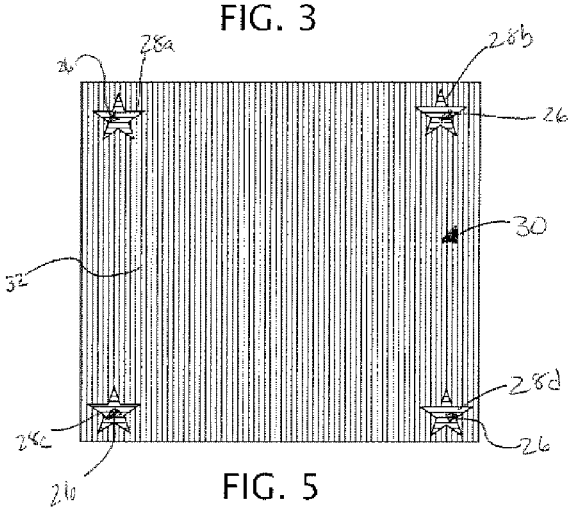
FIG. 5 is a view of a third pattern and a fourth pattern of line elements printed on the substrate in visible ink and having a greatly reduced line frequency.

Reference is now made to FIG. 5, which shows a third pattern of line elements 26 forming latent images 28*a-d* and a fourth pattern of line elements 30 forming a common visually integrated setting 32. Both sets of line elements 26 and 30 are printed in visible ink on the same substrate 10 having the invisible ink. To view the latent image 28*a-d* in visible ink, a visual aid, such as a reader device 34, is required.

At least one of the first and second patterns of line elements 16, 20 is preferably positioned to overlap the third and fourth patterns of line elements 26, 30. The overlapping patterns of line elements 16, 20, 26, 30 are arranged so that when the region 14 is illuminated by the light containing the non-visible wavelength, any interference effects are substantially indistinguishable between the latent image 18 formed by the first pattern 16 and its visually integrated setting 22 formed by the second pattern 20.

In certain embodiments of the present invention, the light containing the non-visible wavelength can also include a visible wavelength for illuminating the visible ink so that both latent images 18, 28*a-d* can be viewed by readers 24, 34, respectively. Any interference effects between the latent image 28*a-d* formed by the third pattern 26 and its visually integrated setting 32 formed by the fourth pattern 30 are also substantially indistinguishable when illuminated by the light containing both invisible and visible wavelengths. For example, any interference between any of the overlapping patterns occurs at moiré frequencies that are not readily discernible. However, the latent image 18 formed by the first pattern 16 is distinguishable from its visually integrated setting 22 formed by the second pattern 20 when both (a) illuminated by the light containing the non-visible wavelength and (b) viewed through a reader containing a pattern matching one of the first and second patterns of line elements 16, 20. The non-visible ink may be illuminated by actinic radiation containing one or more invisible wavelengths. The latent image 28*a-d* formed by the third pattern 26 is distinguishable from its visually integrated setting 32 formed by the fourth pattern 30 when both (a) illuminated by the light containing the visible wavelength and (b) viewed through a reader containing a pattern matching one of the third and forth patterns of line elements 26, 30.

Although four patterns of line elements 16, 20, 26 and 30 are discussed supra, it should be appreciated that the printing substrate 10 can have only a single visible pattern of line elements 26 overlapped by the first and second invisible patterns of line elements 16, 20. Having four patterns is preferred, however, because the third and fourth patterns of line elements 26, 30 can form the latent image 28*a-d* and the visually integrated setting 32, which are not readily distinguishable to the unaided eye when illuminated by visible light, but which reveals the latent image 28*a-d* when a reader device 34 is placed over the region 14.

Figure 6:
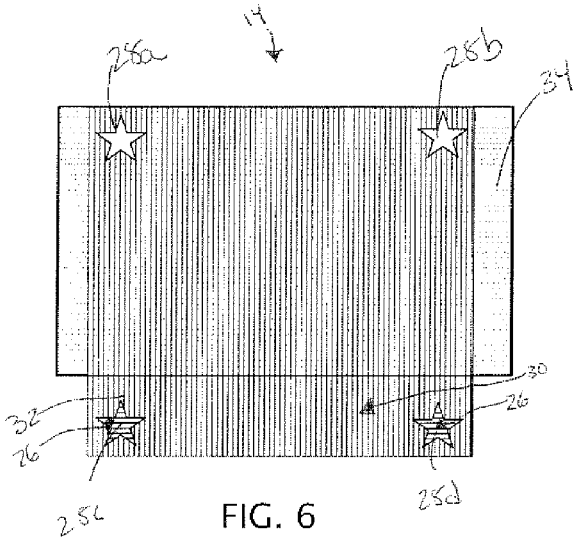
FIG. 6 is a view of a reader placed over the printing substrate to reveal a latent image formed by the third pattern of line elements and having a greatly reduced line frequency.

FIG. 6 depicts the reader device 34 positioned over the region 14 while viewing the underlying printing substrate under light containing a visible wavelength will cause the latent image 28*a-d* to appear. The reader device 34 can include a translucent pattern, whereby the pattern diffuses the light so that the latent image 28*a-d* appears as a solid image rather than a patterned image. Again, it should be appreciated that the line frequency in FIG. 6 is greatly reduced for purposes of illustration to reveal the third and fourth patterns of line elements 26, 30, which would not otherwise be readily distinguishable to the unaided eye.

Figure 7:
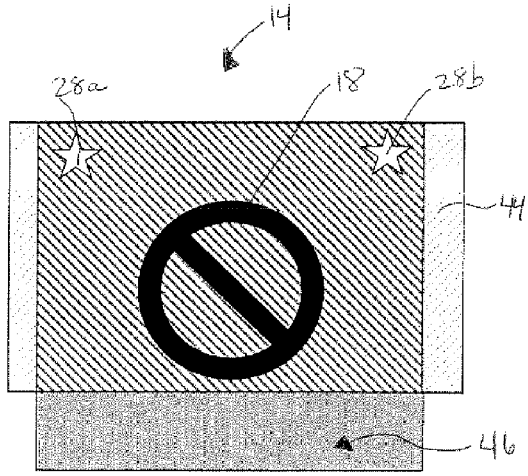
FIG. 7 is a view of a reader having two different reader patterns, placed over the printing substrate having the first and second patterns of line elements overlapping the third and fourth patterns of line elements.

As shown in FIG. 7, a reader has a first region containing a pattern of line elements region corresponding to the first pattern 16 and has a second region containing a pattern of line elements region corresponding to the third pattern 26. Thus, one reader 44 can allow both latent images 18, 28*a-d* to be viewed simultaneously. It should be appreciated that because the reader 44 is not placed over the bottom section 46 of the region 14, one cannot see the images 28*c*, 28*d* shown on the bottom of FIG. 6. Upon moving the reader to the bottom of the region 14, the reader will reveal the bottom images 28*c*, 28*d*. In the bottom position, the region of the reader 44 having the pattern that corresponds to the third pattern 26 is aligned with the bottom images 28*c*, 28*d*. The reader 44 includes patterns of line elements that can be printed on the device itself or may be formed in or through the surface of the device.

The first pattern of line elements 16 are printed on the printing substrate 10 as the latent image 18 and in invisible ink. Then, a second pattern of line elements 20 are printed on the printing substrate 10 as the visually integrated setting 22 for the latent image 18 in an invisible ink. The print densities of the first and second patterns 16, 20 are matched so that the first and second patterns 16, 20 remain substantially indistinguishable to the unaided eye when illuminated by the light containing the non-visible wavelength. The viewing reader 24 differentiates the first and second patterns 16, 20 so that only the latent image 18 is distinguished from the visually integrated setting 22.

The first and second patterns 16, 20 are oriented at different angles separated by at least five degrees and appear in substantially the same color when illuminated by the non-visible wavelength light. That is, having the first pattern of line elements 16 oriented at an angle of 45 degrees will require the second pattern of line elements 20 to be oriented at an angle of at least 40 degrees or less or 50 degrees or more. A third and fourth pattern of line elements 26, 30 can be printed on the printing substrate 10 in a visible ink such that at least one of the first and second patterns 16, 20 overlaps at least one of the third and fourth patterns 26, 30, which are arranged so that when illuminated by the light containing the non-visible wavelength, any interference effects are substantially indistinguishable between the latent images 18, 28 of the first and third patterns 16, 26 and their visually integrated settings 22, 32 of the second and fourth patterns 20, 30. For example, any interference between any of the overlapping patterns occurs at moiré frequencies that cannot be readily discernible to the human eye.

In other embodiments of the present invention, the security image is printed with an ink visible only under infrared light, X-rays or Gamma radiation, rather than UV light.

These embodiments of the present invention enable enhanced security to be incorporated into any type of document including product packages, passports, legal documents, checks, identification cards, drivers' licenses, currency, laminate films, etc. Their use is advantageous in that a counterfeiter would not know that the latent images even exist unless they had the reader device and the correct light source.

Those of skill in the art will appreciate that a variety of images may be printed in accordance with the principles of the present invention to prevent unauthorized copying of those images. For example, artwork, such as prints and posters, may also be printed in accordance with the principles of the present invention to thwart unauthorized copying, duplication or use of the artwork. The principles of the present invention may also be used to print security images, including latent security images, which may be used on a variety of documents.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes that come within the meaning and range of equivalency of the claims are therefore intended to be embraced therein.

The invention claimed is:

1. A print medium containing an invisible security image comprising:

a printed substrate, a first pattern of line elements forming a latent image printed on the substrate in an invisible ink that is rendered visible when illuminated by light containing a non-visible wavelength, a second pattern of line elements forming a visually integrated setting for the latent image printed on the substrate in an invisible ink that is rendered visible when illuminated by the light containing the non-visible wavelength, the first and second patterns differing from each other but being not readily distinguishable to an unaided eye when illuminated by the light containing the non-visible wavelength, and a third pattern of line elements printed on the substrate in a visible ink, wherein at least one of the first and second patterns of line elements overlaps the third pattern of line elements, and wherein the overlapping patterns of line elements in visible and non-invisible ink are arranged so that when illuminated by the light containing the non-visible wavelength, any interference effects are substantially indistinguishable between the latent image formed by the first pattern and its visually integrated setting formed by the second pattern, and wherein the interference between the overlapping patterns occurs at moiré frequencies that are not readily discernible.

2. The print medium of claim 1 in which the first and second patterns appear as substantially the same color when illuminated by the light containing the non-visible wavelength.

3. The print medium of claim 2 in which the first and second patterns are printed with corresponding print densities.

4. The print medium of claim 1 in which the line elements of the first and second patterns are printed in lines oriented at different angles separated by at least five degrees.

5. The print medium of claim 1 in which the light containing the non-visible wavelength also includes a visible wavelength for illuminating the visible ink.

6. The print medium of claim 1 in which the latent image formed by the first pattern is distinguishable from its visually integrated setting formed by the second pattern when both illuminated by the light containing the non-visible wavelength and viewed through a reader containing a pattern matching one of the first and second patterns of line elements.

7. A print medium containing an invisible security image comprising:

a printed substrate, a first pattern of line elements forming a latent image printed on the substrate in an invisible ink that is rendered visible when illuminated by light containing a non-visible wavelength, a second pattern of line elements forming a visually integrated setting for the latent image printed on the substrate in an invisible ink that is rendered visible when illuminated by the light containing the non-visible wavelength, the first and second patterns differing from each other but being not readily distinguishable to an unaided eye when illuminated by the light containing the non-visible wavelength, a third pattern of line elements printed on the substrate in visible ink, wherein at least one of the first and second patterns of line elements overlaps the third pattern of line elements, wherein the overlapping patterns of line elements in visible and non-visible ink are arranged so that when illuminated by the light containing the non-visible wavelength, any interference effects are substantially indistinguishable between the latent image formed by the first pattern and its visually integrated setting formed by the second pattern, and wherein the light containing the non-visible wavelength also includes a visible wavelength for illuminating the visible ink, and a fourth pattern of line elements printed on the substrate in a visible ink, the third pattern forming a latent image, the fourth pattern forming a visually integrated setting, and the third and fourth patterns being not readily distinguishable to the unaided eye when illuminated by the light containing both invisible and visible wavelengths.

8. The print medium of claim 7 in which at least one of the first and second patterns of line elements overlaps the third and fourth patterns of line elements, and the overlapping patterns of line elements in visible and non-visible ink are arranged so that when illuminated by the light containing both visible and non-visible wavelengths, any interference effects are substantially indistinguishable between the latent images formed by the first and third patterns and their visually integrated settings formed by the second and fourth patterns.

9. A document verification system comprising:

a document printed with both visible and invisible ink, the invisible ink being rendered visible when illuminated by actinic radiation containing one or more invisible wavelengths, first and second patterns of line elements being printed with the invisible ink, the first pattern being formed as a latent image that is embedded within a visually integrated setting formed by the second pattern such that the latent image is substantially indistinguishable from its visually integrated setting when illuminated by the actinic radiation, a third pattern of line elements printed on the substrate in a visible ink, wherein at least one of the first and second patterns of line elements overlaps the third pattern of line elements, wherein the actinic radiation also includes one or more visible wavelengths, and the overlapping patterns of line elements in visible and non-visible ink are arranged so that when illuminated by the actinic radiation, any interference effects are substantially indistinguishable between the latent image formed by the first pattern and its visually integrated setting formed by the second pattern, and wherein the interference between the overlapping patterns occurs at moiré frequencies that are not readily discernible, and a reader having a pattern of line elements corresponding to one of the first and second patterns so that in combination with the illumination by the actinic radiation, the latent image is distinguishable from its visually integrated setting.

10. The verification system of claim 9 in which the reader includes a viewing device through which the document is viewed for distinguishing the latent image from its visually integrated setting.

11. The verification system of claim 10 in which the reader pattern is printed on the viewing device.

12. The verification system of claim 10 in which the reader pattern is formed in the surface of the viewing device.

13. A document verification system comprising:

a document printed with both visible and invisible ink, the invisible ink being rendered visible when illuminated by actinic radiation containing one or more invisible wavelengths, first and second patterns of line elements being printed with the invisible ink the first pattern being formed as a latent image that is embedded within a visually integrated setting formed by the second pattern such that the latent image is substantially indistinguishable from its visually integrated setting when illuminated by the actinic radiation, a third pattern of line elements printed on the substrate in a visible ink, wherein at least one of the first and second patterns of line elements overlaps the third pattern of line elements, wherein the actinic radiation also includes one or more visible wavelengths, and the overlapping patterns of line elements in visible and non-visible ink are arranged so that when illuminated by the actinic radiation, any interference effects are substantially indistinguishable between the latent image formed by the first pattern and its visually integrated setting formed by the second pattern, a fourth pattern of line elements printed on the substrate in a visible ink, the third pattern being formed as a latent image that is embedded within a visually integrated setting formed by the fourth pattern such that the latent image is substantially indistinguishable from its visually integrated setting when illuminated by the actinic radiation, and a reader having a pattern of line elements corresponding to one of the first and second patterns so that in combination with the illumination by the actinic radiation, the latent image is distinguishable from its visually integrated setting.

14. The verification system of claim 13 in which the reader pattern of line elements that corresponds to one of the first and second patterns is a first of two reader patterns of line elements, and a second of the reader patterns corresponds to one of the third and fourth patterns so that in combination with the illumination by the actinic radiation, the embedded latent image formed by the third pattern is distinguishable from its visually integrated surrounding formed by the fourth pattern.

15. The verification system of claim 14 in which at least one of the first and second patterns of line elements overlaps both the third and fourth patterns of line elements, and the overlapping patterns of line elements in visible and non-visible ink are arranged so that when illuminated by the actinic radiation containing both visible and non-visible wavelengths, any interference effects are substantially indistinguishable between the latent images formed by the first and third patterns and their visually integrated settings formed by the second and fourth patterns.

16. The verification system of claim 14 in which the reader is a viewing device containing the two reader patterns of line elements in different arrangements.

17. A method of making a document with an embedded invisible security feature comprising steps of:

printing a first pattern of line elements on a document substrate as a latent image in an invisible ink that is rendered visible by when illuminated by light containing an non-visible wavelength, printing a second pattern of line elements on the document substrate as a visually integrated setting for the latent image in an invisible ink that is rendered visible when illuminated by the light containing the non-visible wavelength, matching print densities of the first and second patterns so that the first and second patterns remain substantially indistinguishable to the unaided eye when illuminated by the light containing the non- visible wavelength, otherwise differentiating the first and second patterns so that the latent image of the first pattern is distinguishable from the visually integrated setting of the second pattern with a visual aid, and printing a third pattern of line elements on the document substrate in a visible ink and in a position of the document substrate at which at least one of the first and second patterns of line elements overlaps the third pattern of line elements.

18. The method of claim 17 in which the first and second patterns appear as substantially the same color when illuminated by the light containing the non-visible wavelength.

19. The method of claim 17 in which the step of printing the first and second patterns includes printing the line elements of the first and second patterns in lines oriented at different angles separated by at least five degrees.

20. The method of claim 17 in which the overlapping patterns of line elements printed on the document substrate in visible and non-visible ink are arranged so that when illuminated by the light containing the non-visible wavelength, any interference effects are substantially indistinguishable between the latent image of the first pattern and the visually integrated setting of the second pattern.

21. The method of claim 20 in which the interference between the overlapping patterns occurs at moiré frequencies that are not readily discernible.

22. The method of claim 17 including a step of printing a fourth pattern of line elements on the document substrate in a visible ink, the third pattern being formed as a latent image that is embedded within a visually integrated setting formed by the fourth pattern such that the latent image is substantially indistinguishable from its visually integrated setting when illuminated by the actinic radiation.

23. The method of claim 22 in which at least one of the first and second patterns of line elements overlaps the third and fourth patterns of line elements, and the overlapping patterns of line elements in visible and non-visible ink are printed in patterns that are arranged so that when illuminated by the light containing both visible and non-visible wavelengths, any interference effects are substantially indistinguishable between the latent images formed by the first and third patterns and their visually integrated settings formed by the second and fourth patterns.

* * * * *